US011006800B2

(12) United States Patent
Kwon et al.

(10) Patent No.: US 11,006,800 B2
(45) Date of Patent: May 18, 2021

(54) ROBOT CLEANER

(71) Applicant: SAMSUNG ELECTRONICS CO., LTD., Suwon-si (KR)

(72) Inventors: Ki Hwan Kwon, Hwaseong-si (KR); Jin Wook Yoon, Yongin-si (KR); Dong Wook Kim, Suwon-si (KR); Dong Woo Ha, Hwaseong-si (KR); Seok Man Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 322 days.

(21) Appl. No.: 16/308,568

(22) PCT Filed: May 22, 2017

(86) PCT No.: PCT/KR2017/005280
§ 371 (c)(1),
(2) Date: Dec. 10, 2018

(87) PCT Pub. No.: WO2017/213362
PCT Pub. Date: Dec. 14, 2017

(65) Prior Publication Data

US 2019/0150687 A1 May 23, 2019

(30) Foreign Application Priority Data

Jun. 10, 2016 (KR) ..... 10-2016-0072122

(51) Int. Cl.
*A47L 9/16* (2006.01)
*A47L 9/22* (2006.01)
(Continued)

(52) U.S. Cl.
CPC ..... *A47L 9/1658* (2013.01); *A47L 9/0081* (2013.01); *A47L 9/22* (2013.01); *G10K 11/162* (2013.01);
(Continued)

(58) Field of Classification Search
CPC ..... A47L 9/1658; A47L 9/0081; A47L 9/22; A47L 11/4011; A47L 2201/04; G10K 11/162
See application file for complete search history.

(56) References Cited

U.S. PATENT DOCUMENTS

2008/0276408 A1* 11/2008 Gilbert, Jr. ..... G05D 1/0227 15/320

FOREIGN PATENT DOCUMENTS

DE 79 08 622 2/1980
EP 1 665 972 6/2006
(Continued)

OTHER PUBLICATIONS

International Search Report dated Aug. 11, 2017 from International Patent Application No. PCT/KR2017/005280, 5 pages.
(Continued)

*Primary Examiner* — Andrew A Horton
(74) *Attorney, Agent, or Firm* — Staas & Halsey LLP

(57) ABSTRACT

By improving a structure of a discharge flow path of a robot cleaner, it may be possible to minimize a loss of a suction force, thereby reducing a noise without deteriorating cleaning efficiency. The robot cleaner includes a fan motor configured to generate a suction force, a first housing in which the fan motor is accommodated, a second housing in which the first housing is accommodated, and a chamber positioned between the first housing and the second housing, wherein a plurality of slits are formed in the chamber.

15 Claims, 13 Drawing Sheets

(51) Int. Cl.

| | |
|---|---|
| ***A47L 9/00*** | (2006.01) |
| ***G10K 11/162*** | (2006.01) |
| ***A47L 11/40*** | (2006.01) |

(52) U.S. Cl.
CPC ..... *A47L 11/4011* (2013.01); *A47L 2201/04* (2013.01)

(56) References Cited

FOREIGN PATENT DOCUMENTS

| | | |
|---|---|---|
| JP | 2013-70967 | 4/2013 |
| KR | 2000-0000976 | 1/2000 |
| KR | 2003-0020503 | 3/2003 |
| KR | 10-2006-0046122 | 5/2006 |
| KR | 10-2009-0051345 | 5/2009 |

OTHER PUBLICATIONS

Written Opinion of the International Searching Authority dated Aug. 11, 2017 from International Patent Application No. PCT/KR2017/005280, 7 pages.
Extended European Search Report dated Apr. 17, 2019 from European Patent Application No. 17810485.7, 7 pages.

* cited by examiner

【Fig. 1】
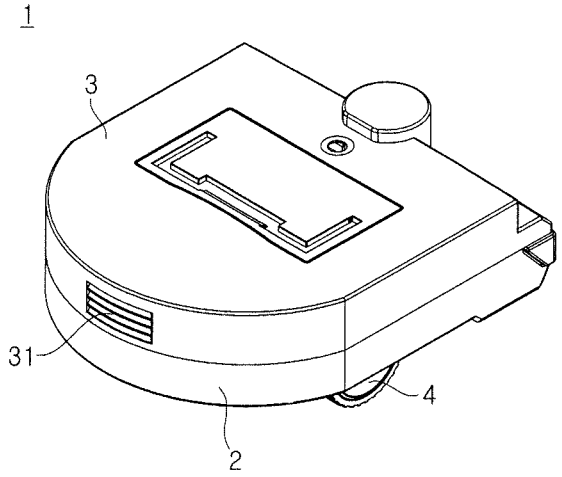

【Fig. 2】
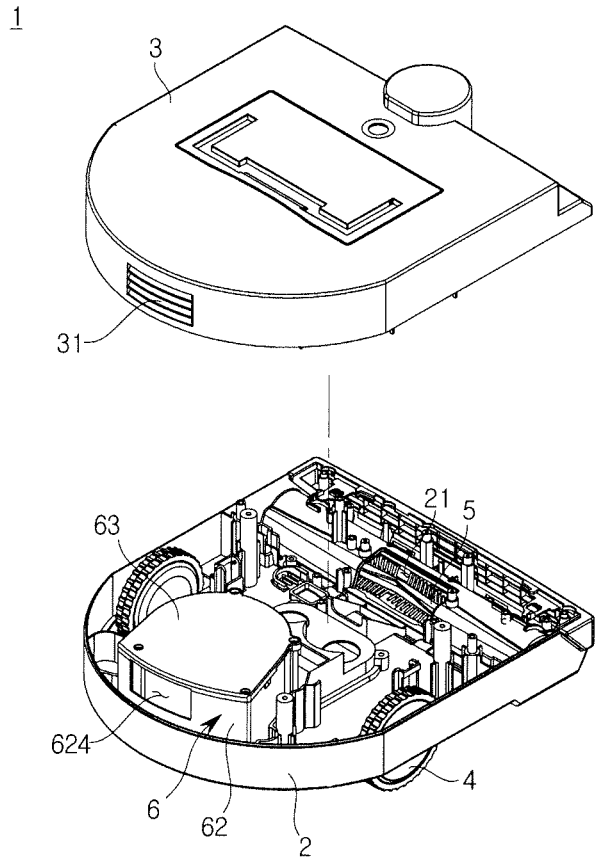

【Fig. 3】
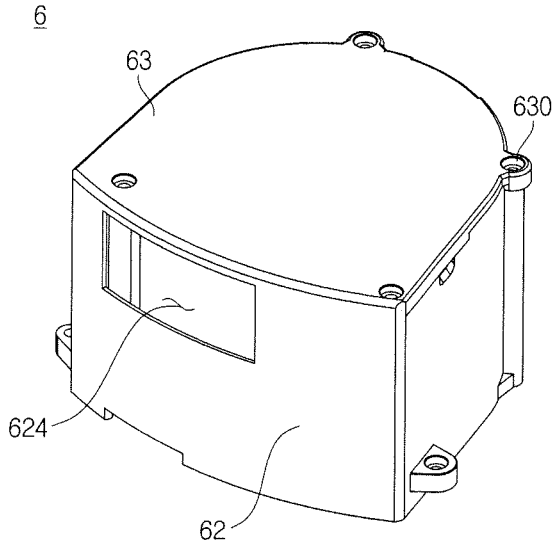

【Fig. 4】
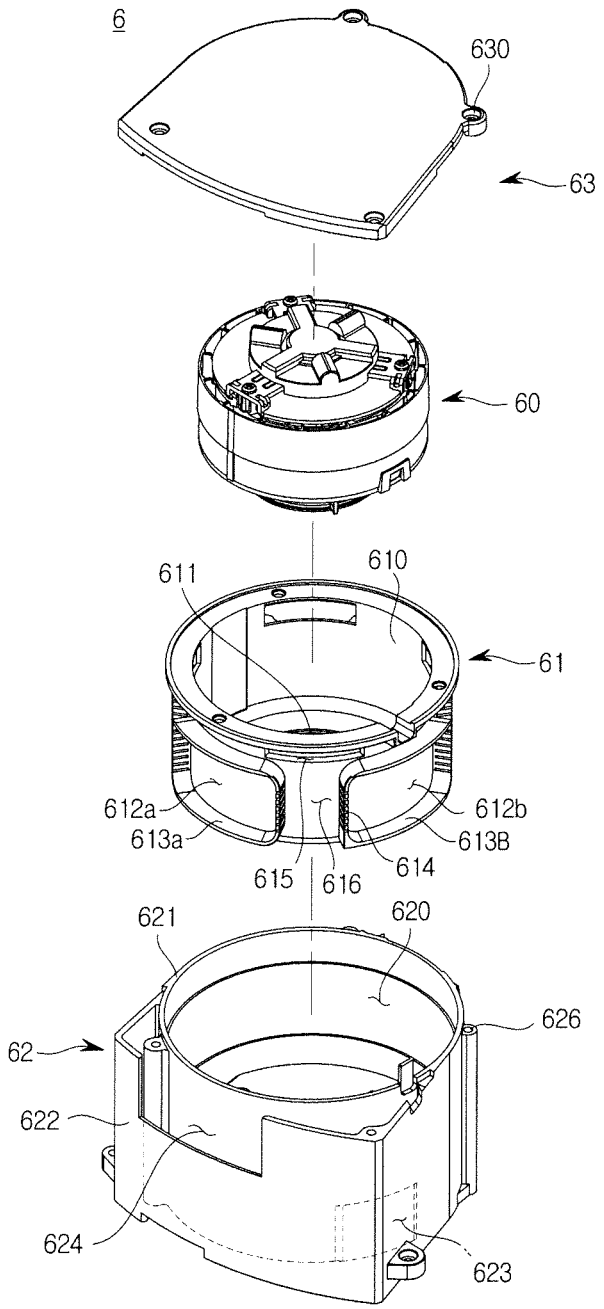

【Fig. 5】
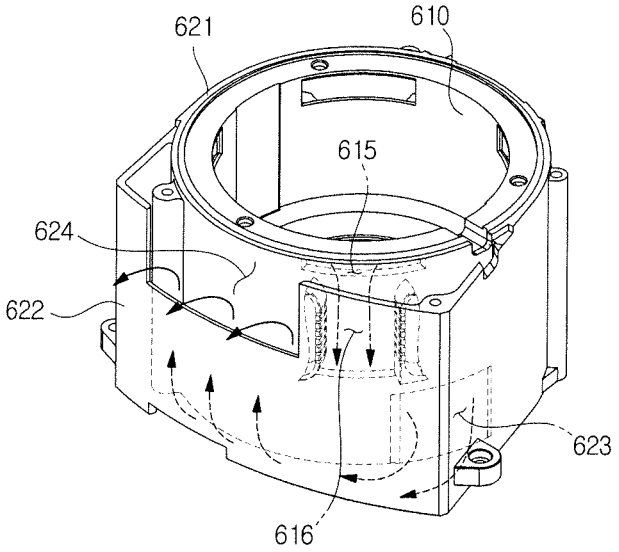

【Fig. 6】
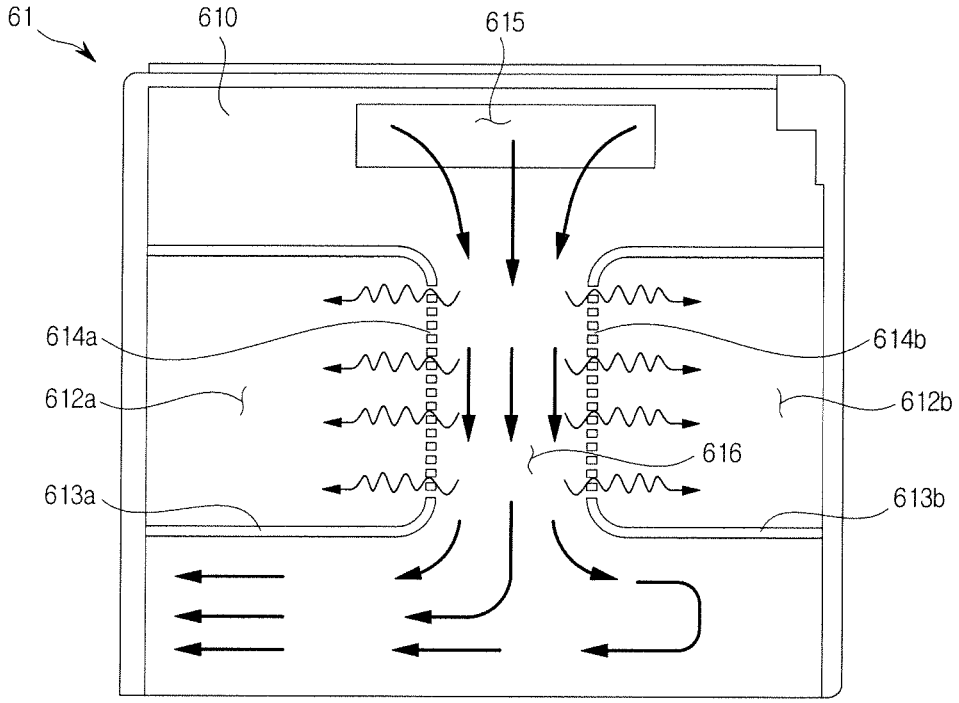

【Fig. 7】
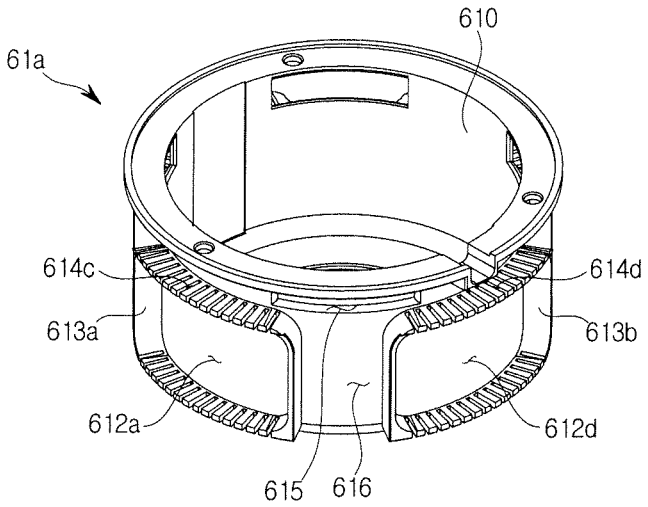

【Fig. 8】
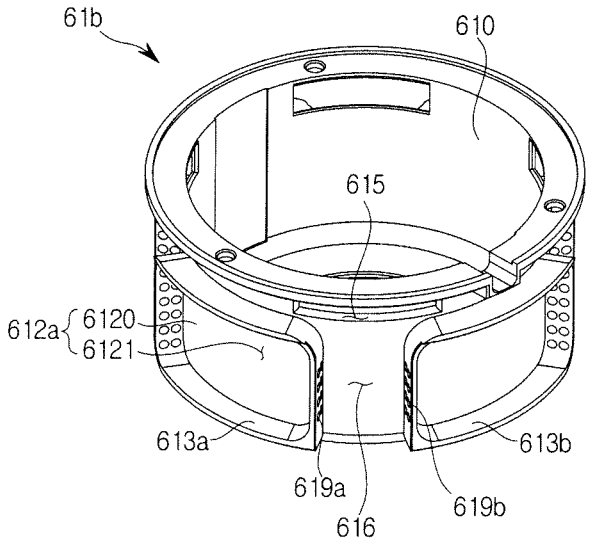

【Fig. 9】
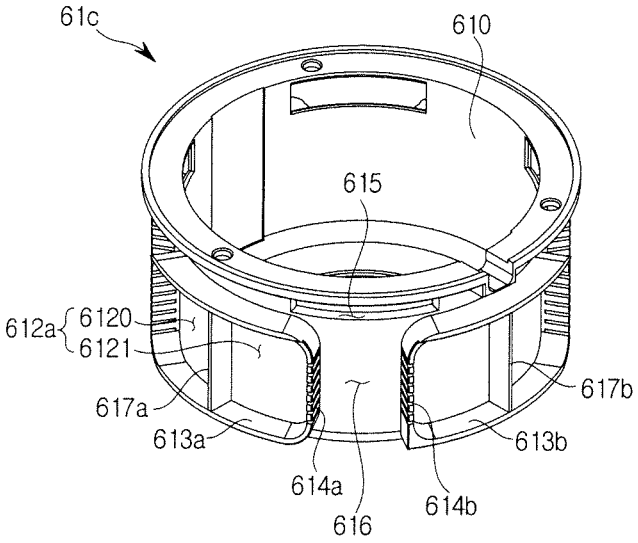

【Fig. 10】
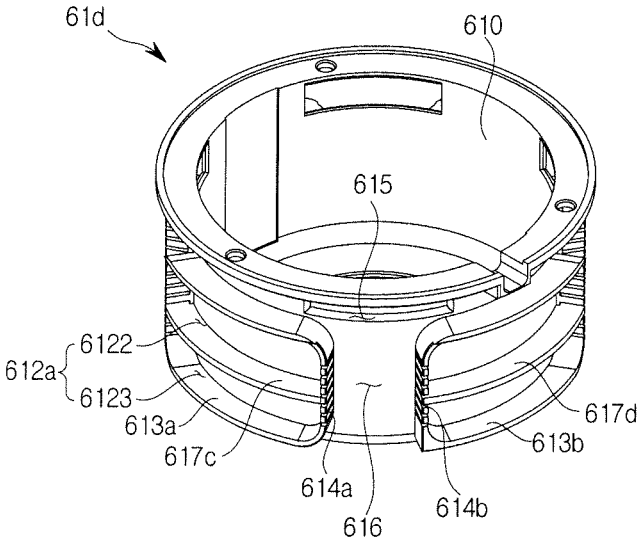

【Fig. 11】
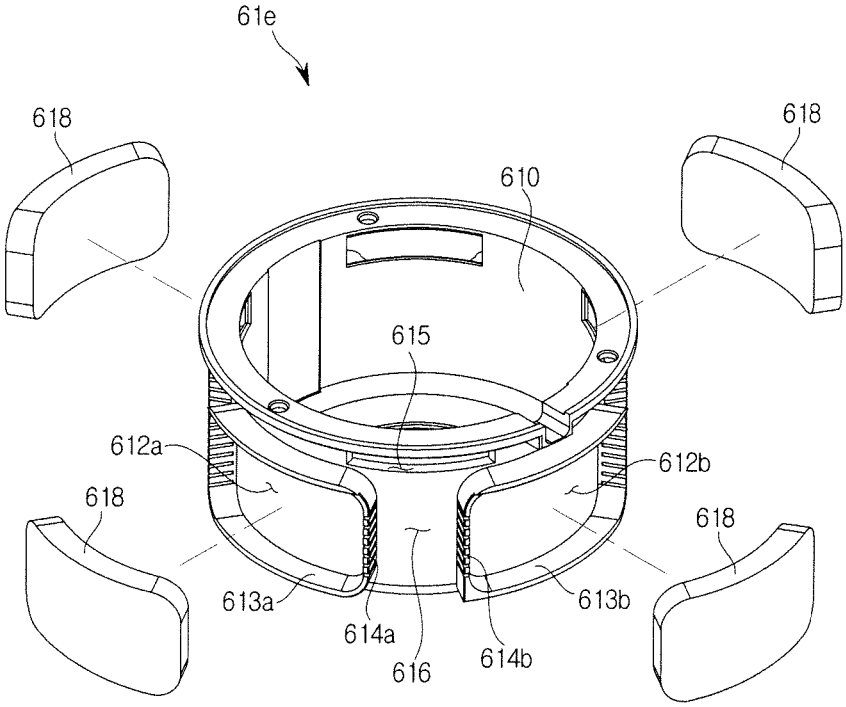

【Fig. 12】
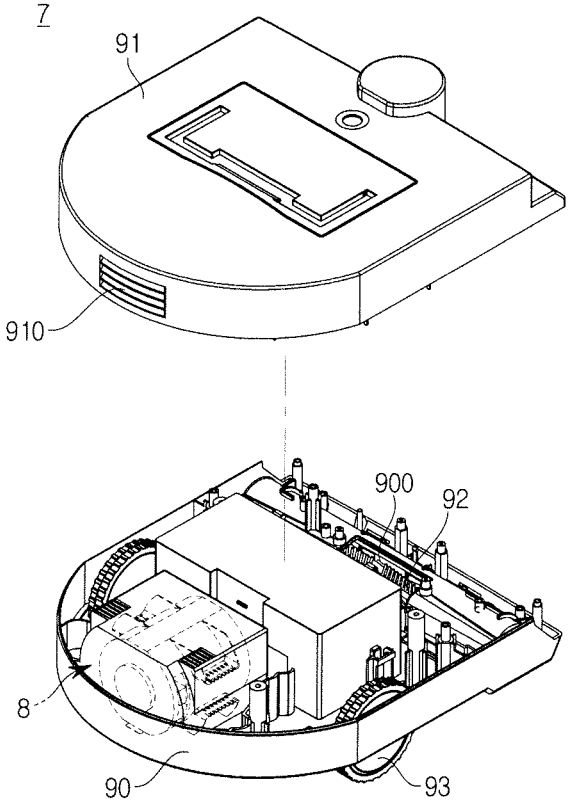

【Fig. 13】
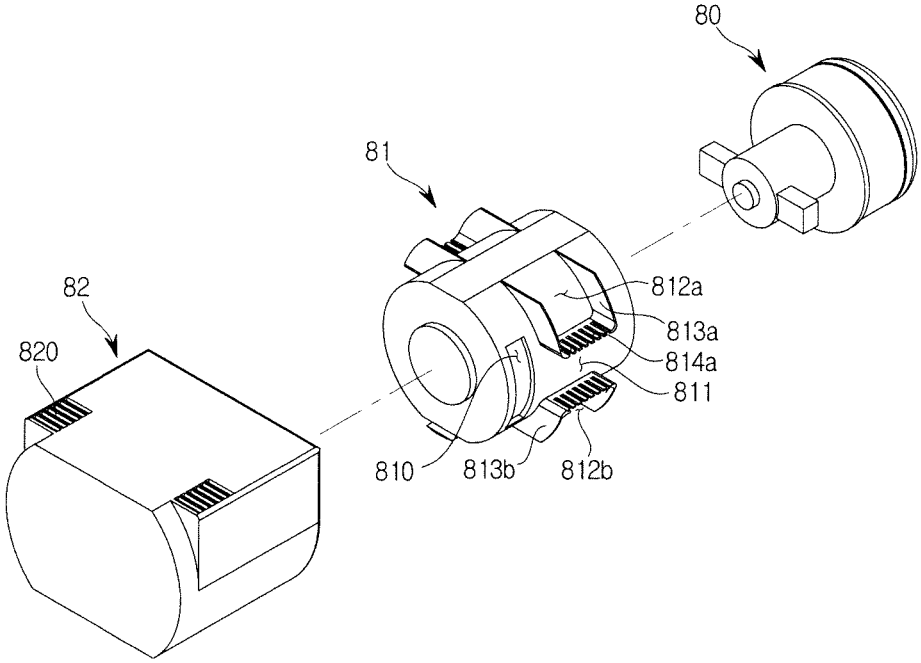

ROBOT CLEANER

CROSS-REFERENCE TO RELATED APPLICATIONS

This application is a U.S. National Stage Application which claims the benefit under 35 U.S.C. § 371 of International Patent Application No. PCT/KR2017/005280 filed on May 22, 2017, which claims foreign priority benefit under 35 U.S.C. § 119 of Korean Patent Application No. 10-2016-0072122 filed Jun. 10, 2016 in the Korean Intellectual Property Office, the contents of both of which are incorporated herein by reference.

TECHNICAL FIELD

The present disclosure relates to a robot cleaner capable of reducing a noise.

BACKGROUND ART

A robot cleaner is equipment that performs cleaning by autonomously traveling on an area to be cleaned without a user's operation and sucking foreign substances such as dust from the floor. During cleaning, the robot cleaner determines a distance to an obstacle, e.g., furniture, office appliances, walls, etc., present in the cleaning area through a distance sensor, and changes its driving direction based on the determined distance to clean the cleaning area.

The robot cleaner includes a main body with a fan motor and wheels for driving the main body. In the bottom of the main body, a suction portion is provided to suck dust on the floor by a suction force of the fan motor. The sucked dust is collected in a dust collector installed in the inside of the main body. In the suction portion, a brush for picking up foreign substances on the floor is installed. The brush is rotatably installed on the bottom of the main body.

The inside space of the robot cleaner is small compared to that of a canister type cleaner or a upright type cleaner, and therefore, a small-volume fan motor is installed in the robot cleaner. The small-volume fan motor provides a weaker suction force than a fan motor installed in the canister type cleaner or the upright type cleaner. However, when the suction force of a fan motor is weak, cleaning efficiency may deteriorate.

A user can operate the robot cleaner to clean the floor, while doing another activity in the same space as the robot cleaner. At this time, if the robot cleaner makes a loud noise, the user may find it uncomfortable to do the activity.

Since a greater suction force of a fan motor generally makes a louder noise, fan motors having a smaller suction force and a smaller volume, compared to those installed in canister type cleaners or upright type cleaners, are installed in typical robot cleaners.

DISCLOSURE

Technical Problem

The present disclosure is directed to providing a robot cleaner capable of reducing a noise by improving a structure of a discharge flow path.

Further, the present disclosure is directed to providing a robot cleaner capable of preventing deterioration of cleaning efficiency through a noise-reducing structure.

Technical Solution

One aspect of the present disclosure provides a robot cleaner including: a fan motor configured to generate a suction force; a first housing in which the fan motor is accommodated; a second housing in which the first housing is accommodated; and a chamber positioned between the first housing and the second housing, wherein a plurality of slits are formed in the chamber.

In a side of the first housing, an inlet opening through which air passed through the fan motor enters the inside of the first housing may be formed, and in another side of the first housing, an outlet opening through which the air entered the inside of the first housing is discharged may be formed.

In a side of the second housing, an outlet hole may be formed, and air entered between the first housing and the second housing through the outlet opening formed in the first housing may be discharged through the outlet hole formed in the second housing.

At least two of the chambers may be provided, and the air entered between the first housing and the second housing may pass between chambers adjacent to each other among the at least two chambers.

The plurality of slits formed in the chambers may be formed in one surface of the chamber opposite to one surface of a chamber adjacent to the chamber.

A plurality of the chambers may be provided to left and right sides of the outlet opening formed in the first housing.

The chamber may be formed by an outer side surface of the first housing, a rib protruding from the outer side surface of the first housing, and an inner side surface of the second housing.

The chamber may include a partition wall partitioning an inside space of the chamber.

A sound-absorbing material may be installed in an inside space of the chamber.

When a plurality of the chambers are provided, a sound-absorbing material may be installed in at least one chamber of the plurality of chambers.

An inside space of the chamber may be partitioned to a plurality of spaces by a partition wall, and a sound-absorbing material may be installed in at least one space of the plurality of spaces.

An inlet opening may be formed in a lower portion of the first housing, and an outlet opening may be formed in an upper portion of the first housing.

Two chambers may be positioned below the outlet opening in such a way to be spaced from each other, and air discharged through the outlet opening may pass between the two chambers.

The second housing may include an inner housing in which the first housing is accommodated, and an outer housing surrounding at least one portion of the inner housing.

The chamber may be positioned between the first housing and the inner housing.

Another aspect of the present disclosure provides a robot cleaner including: a case forming an outer appearance; and a fan motor unit accommodated in the case, wherein the fan motor unit comprises: a fan motor configured to generate a suction force; a first housing in which an inlet opening and an outlet opening are formed and in which the fan motor is accommodated; a second housing in which the first housing is accommodated and in which an outlet hole is formed; and a plurality of chambers positioned between an outer side surface of the first housing and an inner side surface of the second housing, wherein a plurality of slits are formed in the chambers, wherein the plurality of chambers are positioned below the outlet opening in such a way to be spaced from each other in both sides of the outlet opening so that air discharged through the outlet opening of the first housing passes through a space formed between facing chambers of the chambers.

A plurality of slits formed in any one chamber may be located in a portion of the chamber, which is adjacent to another adjacent chamber.

A sound-absorbing material may be installed in at least one chamber of the plurality of chambers.

An inside space of the at least one chamber of the plurality of chambers may be partitioned by a partition wall.

The plurality of chambers may be formed by a rib protruding from an outer side surface of the first housing, the outer side surface of the first housing, and an inner side surface of the second housing.

Advantageous Effects

A robot cleaner according to an embodiment of the present disclosure can improve cleaning efficiency and reduce the generation of noise.

Also, the robot cleaner can prevent a suction force of a fan motor from deteriorating.

DESCRIPTION OF DRAWINGS

FIG. 1 is a perspective view of a robot cleaner according to an embodiment.

FIG. 2 is an exploded perspective view of a robot cleaner according to an embodiment.

FIG. 3 is a perspective view of a fan motor unit according to an embodiment.

FIG. 4 is an exploded perspective view of a fan motor unit according to an embodiment.

FIG. 5 shows flow of air in a fan motor unit according to an embodiment.

FIG. 6 shows a part of a discharge flow path of a fan motor unit according to an embodiment.

FIGS. 7 and 8 show first housings according to other embodiments.

FIG. 9 shows a first housing according to another embodiment.

FIG. 10 shows a first housing according to another embodiment.

FIG. 11 shows a state in which sound-absorbing materials are installed in chambers according to another embodiment.

FIG. 12 is a perspective view of a robot cleaner according to another embodiment.

FIG. 13 shows a state in which air flows in a fan motor unit according to another embodiment.

MODES OF THE INVENTION

Hereinafter, a robot cleaner according to an embodiment will be described in detail with reference to the accompanying drawings.

FIG. 1 is a perspective view of a robot cleaner according to an embodiment, and FIG. 2 is an exploded perspective view of a robot cleaner according to an embodiment.

Referring to FIGS. 1 and 2, a robot cleaner 1 according to an embodiment may include cases 2 and 3 forming an outer appearance, a fan motor unit 6 for generating a suction force, and wheels 4 for driving the robot cleaner 1. Also, a brush unit 5 may be installed at one side of the robot cleaner 1. The brush unit 5 may be rotatably configured to pick up foreign materials on the floor. The robot cleaner 1 may further include a dust collector (not shown) for filtering out foreign materials included in inhaled air to collect the foreign materials.

The cases 2 and 3 may include a lower case 2 in which the fan motor unit 6, etc. are accommodated, and a upper case 3 covering the lower case 3 from above. At one side of the lower case 2, an inlet 21 may be provided. The inlet 21 may be formed in a front bottom of the lower case 2. In the upper case 3, an outlet 31 may be formed through which inhaled air is discharged. The outlet 31 may be formed in a rear side portion of the upper case 3.

Two wheels 4 may be provided around left and right edges of the lower case 2 in such a way to be symmetrical to each other. The wheels 4 may enable the robot cleaner 1 to move forward/backward or rotate.

The brush unit 5 may be positioned in the inlet 21. The brush unit 5 may include a roller rotatably installed in the inlet 21 and a brush surrounding an outer circumferential surface of the roller. The brush unit 5 may rotate to sweep foreign materials on the floor toward the inlet 21.

The fan motor unit 6 may be positioned in the lower case 2. The fan motor unit 6 may be connected to the inlet 21 through a flow path. A dust collector may be positioned between the fan motor unit 6 and the inlet 21 so that foreign materials included in air entered through the inlet 21 are collected in the dust collector, and clean air from which the foreign materials have been filtered out are discharged toward the fan motor unit 6. The clean air may pass through the fan motor unit 6 and then be discharged to the outside through the outlet 31 formed in the upper case 3.

FIG. 3 is a perspective view of a fan motor unit according to an embodiment, and FIG. 4 is an exploded perspective view of a fan motor unit according to an embodiment.

Referring to FIGS. 3 and 4, the fan motor unit 6 according to an embodiment may include a fan motor 60 for generating a suction force, a first housing 61 in which the fan motor 60 is accommodated, and a second housing 62 in which the first housing 61 is accommodated. The second housing 62 may open from above to form an opening 620, and the first housing 61 may be inserted into the inside of the second housing 62 through the opening 620. At a top of the second housing 62, a cover 63 may be provided to cover the opening 620.

The fan motor 60 may provide a stronger suction force than fan motors of typical robot cleaners. Therefore, the fan motor 60 may improve cleaning efficiency of the robot cleaner 1. According to some embodiments, the fan motor 60 may be a fan motor having a strong suction force, which is applied to canister type cleaners or upright type cleaners.

The shape of the first housing 61 may correspond to that of the fan motor 60. When the fan motor 60 is substantially in the shape of a cylinder, the first housing 61 may also be substantially in the shape of a cylinder.

In a side of the first housing 61, an inlet opening 611 through which air inhaled by a suction force of the fan motor 60 enters the inside of the first housing 61 may be formed. The inlet opening 611 may be formed in a bottom of the first housing 61.

Also, in the first housing 61, an outlet opening 615 may be formed to discharge air entered the inside of the first housing 61. The outlet opening 615 may be formed in an upper side portion of the first housing 61. Air entered through the inlet opening 611 formed in the bottom of the first housing 61 may pass through the fan motor 60, and then be discharged through the outlet opening 615 formed in the upper portion of the first housing 61. A single outlet opening 615 or a plurality of outlet openings 615 may be formed.

On an outer surface of the first housing 61, one or more chambers (hereinafter, also referred to as a first chamber 612*a* and a second chamber 612*b*) may be provided to reduce a noise that may be generated by air discharged through the outlet opening 615. The chambers 612*a* and 612*b* may be positioned below the outlet opening 615.

Hereinafter, an embodiment in which two chambers 612*a* and 612*b* are disposed for one outlet opening 615 will be described.

The chambers 612*a* and 612*b* may be positioned below the outlet opening 615 to left and right sides of the outlet opening 615 with the outlet opening 615 in between. More specifically, the first chamber 612*a* and the second chamber 612*b* may be spaced from each other at the left and right sides of the outlet opening 615 with the outlet opening 615 in between. Air discharged through the outlet opening 615 may flow along a space 616 between the first chamber 612*a* and the second chamber 612*b*.

When a single outlet opening 615 is provided, two chambers may be, as described above, spaced from each other to form a flow path through which air discharged from the outlet opening 615 passes. When a plurality of outlet openings 615 are provided, the same number of chambers as that of the outlet openings 615 may be provided in such a way to be spaced from each other, thus forming the same number of flow paths as that of the outlet openings 615.

Meanwhile, the plurality of chambers may have the same size and shape or different sizes and shapes.

Also, the number of the outlet opening 615 may not correspond to the number of the flow path through which air discharged through the outlet opening 615 passes. Air discharged through the outlet opening 615 may circle to move along the flow path formed by the two adjacent chambers 612*a* and 612*b*.

Hereinafter, the two adjacent chambers 612*a* and 612*b* will be described.

On a lateral surface 610 of the first housing 61, a plurality of ribs 613 may protrude in the shape of the chambers 612*a* and 612*b*. When the first housing 61 is accommodated in the second housing 62, the chambers 612*a* and 612*b* may be formed by the outer surface of the first housing 61, an inner surface of the second housing 62, and the ribs 613. The ribs 613 may protrude in the shape of a closed curve from the outer surface of the first housing 61.

In the ribs 613, a plurality of slits 614 may be formed. The plurality of slits 614 may be formed in the ribs 613 to correspond to both sides of the flow path through which air discharged from the outlet opening 615 passes. That is, the plurality of slits 614 may be respectively formed in ribs 613*a* and 613*b* of the first and second chambers 612*a* and 612*b* forming the flow path through which air discharged from the outlet opening 615 passes. The current embodiment relates to a case in which the plurality of slits 614 are formed in the ribs 613, however, a plurality of holes may be formed in the ribs 613. Also, the shape of the slits 614 is not limited to a rectangular shape as shown in FIG. 4, and the slits 614 may be formed in various shapes.

The second housing 62 may have a shape substantially corresponding to the first housing 61. When the first housing 61 is in the shape of a cylinder, the second housing 62 may also be in the shape of a cylinder to correspond to the first housing 61. The second housing 62 may open from above to form the opening 620 in which the first housing 61 is accommodated.

The second housing 62 may include an inner housing 621 forming a space in which the first housing 61 is accommodated, and an outer housing 622 disposed around the outer side of the inner housing 621. The outer housing 622 may surround at least one part of the inner housing 621. A predetermined space may be formed between the inner housing 621 and the outer housing 622.

For air discharged from the outlet opening 615 of the first housing 61 to enter the space between the inner housing 621 and the outer housing 622, an inlet hole 623 may be formed in a portion of the inner housing 621. The inlet hole 623 may be formed in a bottom or a side portion of the inner housing 621. When the inlet hole 623 is formed in the side portion of the inner housing 621, the inlet hole 623 may be formed in a lower side portion of the inner housing 621, which is close to the bottom of the inner housing 621.

An outlet hole 624 may be formed in the outer housing 622 to discharge air entered between the inner housing 621 and the outer housing 622 through the inlet hole 623 to the outside. The outlet hole 624 may be formed in an upper side portion of the outer housing 622.

The outlet hole 624 formed in the outer housing 622 may be located to correspond to the outlet 31 formed in the upper case 3. The air discharged to the outside of the second housing 62 through the outlet hole 624 may be discharged to the outside of the robot cleaner 1 through the outlet 31 formed in the upper case 3.

The cover 63 may cover the opening 620 of the second housing 62 from above. In an edge of the cover 63, a coupling member installing portion 630 may be formed with which a coupling member is coupled. In the second housing 62, a coupling portion 626 may be formed to correspond to the coupling member installing portion 630. The cover 63 may be mounted on the second housing 62 by the coupling member penetrating the coupling member installing portion 630 and the coupling portion 626. However, the cover 63 may be mounted on the second housing 62 in another manner.

FIG. 5 shows flow of air in a fan motor unit according to an embodiment.

Referring to FIG. 5, in a fan motor unit 6 according to an embodiment, air inhaled by the fan motor 60 may enter the inside of the fan motor unit 6 through the inlet opening 611 formed in the first housing 61, and be discharged to the outside of the fan motor unit 6 through the outlet hole 624 formed in the second housing 62.

Air entered the inside of the first housing 61 through the inlet opening 611 may pass through the fan motor 60, and then be discharged through the outlet opening 615 formed in the first housing 61. The air discharged through the outlet opening 615 may enter the space between the inner housing 621 and the outer housing 622 through the inlet hole 623 formed in the inner housing 621 of the second housing 62. The air entered toward the second housing 62 may be discharged to the outside through the outlet hole 624 formed in the outer housing 622.

The air discharged to the outside of the fan motor unit 6 through the outlet hole 624 may be discharged to the outside of the robot cleaner 1 through the outlet 31 formed in the upper case 3.

FIG. 6 shows a part of a discharge flow path of a fan motor unit according to an embodiment.

Referring to FIG. 6, air discharged from the fan motor unit 6 according to an embodiment through the outlet opening 615 of the first housing 61 may pass through the flow path 616 which is the space formed between the adjacent chambers 612*a* and 612*b*. In the rib 613*a* of the first chamber 612*a* adjacent to the second chamber 612*b* and the rib 613*b* of the second chamber 612*b* adjacent to the first chamber 612*a*, a plurality of slits 614*a* and 614*b* may be formed respectively.

That is, the plurality of slits 614*a* and 614*b* may be formed in edges of the flow path 616 through which air discharged through the outlet opening 615 passes.

The air discharged through the outlet opening 615 may enter toward the second housing 62 via the flow path 616. Most of the air may pass through the flow path 616, instead of entering the inside of the chambers 612*a* and 612*b* through the slits 614*a* and 614*b*.

The chambers 612*a* and 612*b* may function to reduce a noise that may be generated by air passing through the flow path 616. The chambers 612*a* and 612*b* may cause a frequency of air passing through the flow path 616 to produce resonance. That is, the chambers 612*a* and 612*b* may cause a frequency of air entered through the plurality of slits 614*a* and 614*b* to produce resonance. Thereby, the chambers 612*a* and 612*b* may reduce a noise that may be generated by inhaled air.

The chambers 612*a* and 612*b* may reduce a noise of a specific frequency region depending on the volume and shape. The volume and shape of the chambers 612*a* and 612*b* may be appropriately adjusted to reduce a noise of a specific frequency region according to an environment, such as the kind of the fan motor 60, the sizes and shapes of the housings 61 and 62 or the cases 2 and 3, etc., in which the robot cleaner 1 is used.

Hereinafter, components of a first housing according to another embodiment will be assigned the same reference numerals as those assigned to the corresponding ones of the first housing described above with reference to FIGS. 3 to 6. Also, in the following description, the chambers included in the first housing mean chambers located between the first housing 61 and the second housing 62, like the chambers 612*a* and 612*b* described above with reference to FIGS. 3 to 6.

FIGS. 7 and 8 show first housings according to other embodiments.

Referring to FIG. 7, a first housing 61*a* according to another embodiment may include the chambers 612*a* and 612*b* formed to the left and right sides of the outlet opening 615 below the outlet opening 615. The chambers 612*a* and 612*b* may be formed by the ribs 613*a* and 613*b*. In the ribs 613*a* and 613*b*, a plurality of slits 614*c* and 614*d* may be formed.

Unlike the slits 614*a* and 614*b* shown in FIGS. 3 to 6, the slits 614*c* and 614*d* may be formed in portions of the ribs 613*a* and 613*b*, which are opposite to each other in a vertical direction. That is, the slits 614*c* and 614*d* may be formed in other locations, not in the edges of the flow path 616 through which air discharged through the outlet opening 615 flows.

However, locations at which the slits 614*c* and 614*d* are formed are not limited to these locations, and the slits 614*c* and 614*d* may be formed in appropriate locations for efficiently reducing a noise of the robot cleaner 1. For example, slits may be formed in at least one of ribs that are vertically opposite to each other or in at least one of ribs that are horizontally opposite to each other.

Referring to FIG. 8, in the chambers 612*a* and 612*b* included in the first housing 61*b*, a plurality of holes 619*a* and 619*b* may be formed, instead of a plurality of slits. The plurality of holes 619*a* and 619*b* may be formed at both adjacent ribs 613 and 613*b* in the two adjacent chambers 612*a* and 612*b*. Also, when the plurality of holes 619*a* and 619*b* are formed in the ribs 613*a* and 613*b*, a noise generated by inhaled air may be reduced due to resonance by the chambers 612*a* and 612*b* without interfering with flow of air, like the embodiment in which the plurality of slits 614*a* and 614*b* are formed in the ribs 613*a* and 613*b*.

Also, the shape of the chambers 612*a* and 612*b* is not limited to the rectangular shape shown in FIGS. 3 to 8. Accordingly, locations in which slits or holes are formed may also be appropriately selected according to a shape of chambers or an environment of a fan motor unit.

FIG. 9 shows a first housing according to another embodiment.

Referring to FIG. 9, a first housing 61*c* according to another embodiment may include one or more chambers 612*a* and 612*b*. Hereinafter, the chamber 612*a* located to the left of the outlet opening 615 will be described. When a plurality of chambers are included in the first housing 61*c*, the following content about the chamber 612*a* will be applied in the similar manner to the other chambers.

The chamber 612*a* may include one or more partition walls 617*a* and 617*b*. An inside space of the chamber 612*a* may be partitioned by the partition walls 617*a* and 617*b*.

By partitioning the space of the chamber 612*a* by the partition walls 617*a* and 617*b* to change the volume and shape of the chamber 612*a*, a frequency region causing resonance may vary. Resonance produced by the chamber 612*a* may reduce a noise generated by air discharged through the outlet opening 615. Since the chamber 612*a* is partitioned by the partition walls 617*a* and 617*b*, a noise of a specific frequency region may be reduced.

The partition walls 617*a* and 617*b* may extend vertically in the inside of the chamber 612*a*, as shown in FIG. 9. A plurality of partition walls 617*a* and 617*b* may be positioned in the inside of the chamber 612*a*, as necessary, and also, the partition walls 617*a* and 617*b* may have a bent shape. Also, spaces 6120 and 6121 partitioned by the partition walls 617*a* and 617*b* may have the same volume or different volumes.

The remaining components except for the partition walls 617*a* and 617*b* may be the same as or similar to the corresponding ones included in the first housing described above with reference to FIGS. 3 to 8.

FIG. 10 shows a first housing according to another embodiment.

Referring to FIG. 10, a first housing 61*d* may include one or more chambers 612*a* and 612*b*, like the first housing 61*c* shown in FIG. 9. Hereinafter, a chamber 612*a* located to the left of the outlet opening 615 will be described. When a plurality of chambers are included in the first housing 61*c*, the following content about the chamber 612*a* will be applied in the similar manner to the other chambers.

In the chamber 612, one or more partition walls 617*c* and 617*d* may be included. The partition walls 617*c* and 617*d* may extend horizontally in the inside of the chamber 612*a*. The partition walls 617*c* and 617*d* may partition the inside space of the chamber 612*a* to change the volume and shape of the chamber 612*a*, like the partition walls 617*a* and 617*b* shown in FIG. 9. Spaces 6122 and 6123 partitioned by the partition walls 617*c* and 617*d* may have the same volume or different volumes. The chamber 612*a* including the partition walls 617*c* and 617*d* may reduce a noise of a specific frequency region caused by air discharged through the outlet opening 615.

The remaining components except for the partition walls 617*c* and 617*d* may be the same as or similar to the corresponding ones included in the first housing described above with reference to FIGS. 3 to 8.

The direction in which the partition walls 617*a* and 617*b* or 617*c* and 617*d* extend is not limited to the embodiments shown in FIGS. 9 and 10. A plurality of partition walls may be included in one chamber, as necessary, and also, the partition walls may have a bent shape. Also, an inside space of each chamber partitioned by the partition walls may have the same volume or different volumes.

When a plurality of chambers are provided, inside spaces of the plurality of chambers may be partitioned to different shapes, respectively, by a plurality of partition walls to cause resonance with respect to different frequency regions.

As such, the volume of each chamber may be adjusted by at least one partition wall to reduce a noise of a specific frequency region.

FIG. 11 shows a state in which sound-absorbing materials are installed in chambers according to another embodiment.

Referring to FIG. 11, one or more sound-absorbing materials 618 may be positioned in the chambers 612*a* and 612*b* provided in a first housing 61*e* according to another embodiment. The sound-absorbing materials 618 may be made of a substance that absorbs energy of sound, and may include wool, a sponge, or a porous fiber material such as a glass fiber. In some embodiments, a plate material, such as plywood or a hard fiberboard, may be used.

By positioning the sound-absorbing materials 618 in the chambers 612*a* and 612*b*, a noise that may be generated in the fan motor unit 6 may be more efficiently reduced.

When a plurality of chambers are included in the first housing 61*e*, the sound-absorbing materials 618 may be located in the respective chambers or in some of the chambers. Also, when the chambers are partitioned by partition walls to form partitioned spaces, the sound-absorbing materials 618 may be located in the respective partitioned spaces or in some of the partitioned spaces.

FIG. 12 is a perspective view of a robot cleaner according to another embodiment, and FIG. 13 shows a state in which air flows in a fan motor unit according to another embodiment.

Referring to FIGS. 12 and 13, a robot cleaner 7 according to another embodiment may be different from the robot cleaner 1 shown in FIGS. 1 to 11 in that a fan motor unit 8 is positioned horizontally in the inside of the robot cleaner 7. In the robot cleaner 1 shown in FIGS. 1 to 11, the fan motor unit 6 may be positioned vertically.

The above description about the brush unit 5, the wheels 4, the lower case 2, and the upper case 3 shown in FIGS. 1 to 11 may be applied in the similar manner to a brush unit 92, wheels 93, a lower case 90, and an upper case 91 except for the fan motor unit 8 positioned horizontally.

In the robot cleaner 1 shown in FIGS. 1 to 11, the fan motor unit 6 may be positioned vertically so that air inhaled through the inlet 21 enters the fan motor unit 6 through the inlet opening 611 formed in the bottom of the fan motor unit 6. The air entered the fan motor unit 6 may pass through the fan motor 60 and then be discharged through the outlet opening 615 located in the upper portion of the first housing 61. The air discharged through the outlet opening 615 may pass through the space between the first housing 61 and the second housing 62 and then be discharged to the outside of the fan motor unit 6 through the outlet hole 624 formed in the upper portion of the second housing 62.

As such, in the robot cleaner 1 shown in FIGS. 1 to 11, inhaled air may move in the vertical direction.

However, in the robot cleaner 7 according to another embodiment as shown in FIGS. 12 and 13, the fan motor unit 8 may be positioned horizontally so that air inhaled through an inlet 900 may move horizontally. Also, the above description about the robot cleaner 1 shown in FIGS. 1 to 11 may be applied in the similar manner to the robot cleaner 7 shown in FIGS. 12 and 13, except that air moves horizontally.

A fan motor 80 may be accommodated in a first housing 81, and the first housing 81 may be accommodated in a second housing 82. The first housing 81 may include one or more chambers 812*a* and 812*b* in which a plurality of slits are formed, to reduce a noise that is generated by flow of air. The chambers 812*a* and 812*b* may be formed by one or more ribs 813*a* and 813*b* protruding from an outer side surface of the first housing 81. Inside spaces of the chambers 812*a* and 812*b* may be partitioned by one or more partition walls. Also, one or more sound-absorbing materials may be installed in the chambers 812*a* and 812*b*.

Air entered the fan motor unit 8 may pass through the fan motor 80 and then be discharged to the space between the first housing 81 and the second housing 82 through an outlet opening 810 formed in the first housing 81. The air entered the space between the first housing 81 and the second housing 82 may be discharged to the outside of the fan motor unit 8 through an outlet hole 820 formed in the second housing 82. The air discharged to the outside of the fan motor unit 8 may be discharged to the outside of the robot cleaner 7 through an outlet 910 formed in the upper case 91.

As described above, by forming chambers in a housing of a fan motor unit, and forming a plurality of slits in ribs forming the chambers, it may be possible to reduce a noise that may be generated by flow of air. Also, the chambers in which the plurality of slits provided to reduce a noise are formed may be positioned in the edges of a flow path so as not to interfere with flow of air, thereby preventing a suction force of a fan motor from being lost.

By the configuration, it may be possible to reduce a noise caused by flow of air without any loss in suction force of the fan motor. Also, by changing the volume and shape of the chambers, a noise of a specific frequency region may be reduced.

The above description about the configuration of the chambers in which the plurality of slits are formed to reduce a noise may also be applied in the similar manner to stick type cleaners, canister type cleaners, and the like, as well as robot cleaners.

The invention claimed is:

1. A robot cleaner comprising:

a fan motor configured to generate a suction force;

a first housing in which the fan motor is accommodated;

a second housing in which the first housing is accommodated; and a chamber positioned between the first housing and the second housing, wherein a plurality of slits are formed in the chamber.

2. The robot cleaner of claim 1, wherein in a side of the first housing, an inlet opening through which air passed through the fan motor enters the inside of the first housing is formed, and in another side of the first housing, an outlet opening through which the air entered the inside of the first housing is discharged is formed.

3. The robot cleaner of claim 2, wherein in a side of the second housing, an outlet hole is formed, and air entered between the first housing and the second housing through the outlet opening formed in the first housing is discharged through the outlet hole formed in the second housing.

4. The robot cleaner of claim 3, wherein at least two of the chambers are provided, and the air entered between the first housing and the second housing passes between chambers adjacent to each other among the at least two chambers.

5. The robot cleaner of claim 4, wherein the plurality of slits formed in the chamber are formed in one surface of the chamber opposite to one surface of a chamber adjacent to the chamber.

6. The robot cleaner of claim 2, wherein a plurality of the chambers are provided to left and right sides of the outlet opening formed in the first housing.

7. The robot cleaner of claim 1, wherein the chamber is formed by an outer side surface of the first housing, a rib protruding from the outer side surface of the first housing, and an inner side surface of the second housing.

8. The robot cleaner of claim 1, wherein the chamber includes a partition wall partitioning an inside space of the chamber.

9. The robot cleaner of claim 1, wherein a sound-absorbing material is installed in an inside space of the chamber.

10. The robot cleaner of claim 1, wherein when a plurality of the chambers are provided, a sound-absorbing material is installed in at least one chamber of the plurality of chambers.

11. The robot cleaner of claim 1, wherein an inside space of the chamber is partitioned to a plurality of spaces by a partition wall, and a sound-absorbing material is installed in at least one space of the plurality of spaces.

12. The robot cleaner of claim 1, wherein an inlet opening is formed in a lower portion of the first housing, and an outlet opening is formed in an upper portion of the first housing.

13. The robot cleaner of claim 12, wherein two chambers are positioned below the outlet opening in such a way to be spaced from each other, and air discharged through the outlet opening passes between the two chambers.

14. The robot cleaner of claim 1, wherein the second housing includes an inner housing in which the first housing is accommodated, and an outer housing surrounding at least one portion of the inner housing.

15. The robot cleaner of claim 1, wherein the chamber is positioned between the first housing and the inner housing.

* * * * *